US007532831B2

(12) United States Patent
Kitano

(10) Patent No.: US 7,532,831 B2
(45) Date of Patent: May 12, 2009

(54) IMAGE FORMATION APPARATUS PROVIDED WITH PHOTOCONDUCTOR AND CHARGING DEVICE

(75) Inventor: Yoshihisa Kitano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 316 days.

(21) Appl. No.: 11/525,808

(22) Filed: Sep. 25, 2006

(65) Prior Publication Data

US 2007/0166063 A1 Jul. 19, 2007

(30) Foreign Application Priority Data

Jan. 18, 2006 (JP) ..... P2006-009948

(51) Int. Cl.
*G03G 15/02* (2006.01)
*G03G 15/00* (2006.01)

(52) U.S. Cl. ..... 399/50; 399/44

(58) Field of Classification Search ..... 399/44, 399/50, 97, 168, 176; 361/212, 221, 225
See application file for complete search history.

(56) References Cited

U.S. PATENT DOCUMENTS 5,832,333 A * 11/1998 Umeda et al. ..... 399/50
5,842,081 A * 11/1998 Kaname et al. ..... 399/50
6,324,357 B1 * 11/2001 Gomi et al. ..... 399/50
2003/0118366 A1 * 6/2003 Nukada et al.
2007/0166066 A1 * 7/2007 Kitano ..... 399/50

FOREIGN PATENT DOCUMENTS

JP B-3416826 4/2003
JP 2004-333789 11/2004

* cited by examiner

*Primary Examiner*—Susan S Lee
(74) *Attorney, Agent, or Firm*—Morgan, Lewis & Bockius LLP

(57) ABSTRACT

An image formation apparatus is provided and includes: a photoconductor; a charging section that applies a bias voltage having an AC voltage superposed on a DC voltage to the photoconductor so as to charge the photoconductor; a controller that controls at least one of the AC voltage and an AC current in response to a fluctuation amount of a DC current flowing between the photoconductor and the charging section when an AC voltage is applied; and a detector that detects the DC current.

6 Claims, 6 Drawing Sheets

IMAGE FORMATION APPARATUS PROVIDED WITH PHOTOCONDUCTOR AND CHARGING DEVICE

BACKGROUND (i) Technical Field

This invention relates to an image formation apparatus of a printer, a copier, a facsimile, or the like.

(ii) Related Art

In this kind of image formation apparatus, a charging device for applying a bias voltage with an AC voltage superposed on a DC voltage for uniformly charging a photoconductor is widely used. It is known that if the AC voltage in the bias voltage is lowered to a value at which the photoconductor surface potential becomes a saturation point or less, an image defect (image chip, color change, etc.,) caused by uneven charging of the photoconductor occurs and the quality of an output image is degraded.

On the other hand, an art of using a high-hardness material for the surface layer of a photoconductor to suppress abrasion of the surface of the photoconductor for prolonging the life of the photoconductor is also known. However, if abrasion of the photoconductor surface is suppressed, a corona product is deposited on the photoconductor surface and causes an image defect (image chip, color change, etc.,) to occur. To suppress occurrence of the corona product, the AC voltage applied to the photoconductor needs to be lowered; however, if the AC voltage is lowered to the value of the saturation point of the photoconductor surface potential or less, an image defect caused by uneven charging occurs as described above. In all the related arts described above, it is difficult to suppress both of uneven charging and occurrence of a corona product.

SUMMARY

According to an aspect of the invention, there is provided an image formation apparatus including: a photoconductor; a charging section that applies a bias voltage having an AC voltage superposed on a DC voltage to the photoconductor so as to charge the photoconductor; a controller that controls at least one of the AC voltage and an AC current in response to a fluctuation amount of a DC current flowing between the photoconductor and the charging section when an AC voltage is applied; and a detector that detects the DC current.

BRIEF DESCRIPTION OF THE DRAWINGS

Exemplary embodiments of the present invention will be described in detail based on the following figures, wherein.

DETAILED DESCRIPTION

The expression "fluctuation amount of DC current" in this specification is used to mean the fluctuation amount of the DC current value when a bias is applied, for example, it is used to mean the difference between the maximum value and the minimum value of the DC current values. In addition, the case where the fluctuation amount is calculated by a statistical calculation method, etc., is contained.

Referring now to the accompanying drawings, there is shown an exemplary embodiment of the invention.

Figure 1:
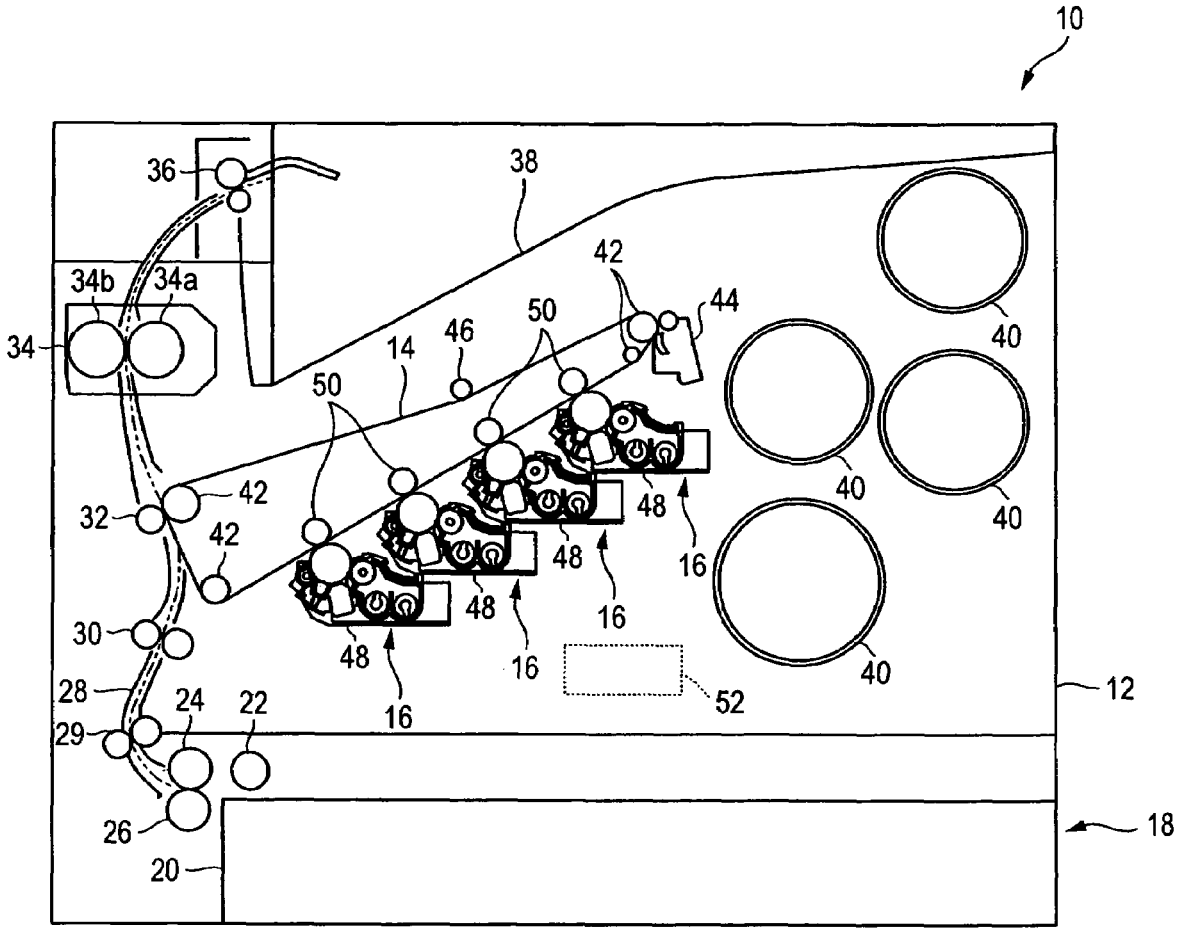
FIG. 1 is a side view to show an image formation apparatus according to an exemplary embodiment of the invention.

FIG. 1 shows an image formation apparatus 10 according to an exemplary embodiment of the invention. This image formation apparatus 10 has an image formation apparatus main unit 12 containing an intermediate transfer belt 14. For example, four image formation sections 16 are placed side by side on the intermediate transfer belt 14, forming the image formation apparatus 10 as a tandem system. The image formation sections 16 form yellow, magenta, cyan, and black toner images on the intermediate transfer belt 14.

A sheet supply unit 18 is provided below the image formation apparatus main unit 12. The sheet supply unit 18 has a sheet supply cassette 20 loaded with sheets, a pickup roller 22 for picking up a sheet loaded on the sheet supply cassette 20, and a feed roller 24 and a retard roller 26 for delivering sheets while separating the sheets. The sheet supply cassette 20 is provided detachably for the image formation apparatus main unit 12 and is loaded with sheets as transfer media such as plain paper and OHP sheets.

A sheet transportation path 28 is provided almost along the vertical direction in the vicinity of one end of the image formation apparatus main unit 12 (in the vicinity of the left end in the figure). The sheet transportation path 28 is provided with a transport roller 29, a registration roller 30, a second transfer roller 32, a fixing device 34, and an ejection roller 36. The registration roller 30 temporarily stops the sheet delivered to the sheet transportation path 28 and sends the sheet to the second transfer roller 32 at a proper timing. The fixing device 34 includes a heating roller 34*a* and a pressurization roller 34*b* for adding heat and pressure to the sheet passing through the nip between the heating roller 34*a* and the pressurization roller 34*b*, thereby fixing a toner image onto the sheet.

An ejection tray section 38 is provided in the upper part of the image formation apparatus main unit 12. The sheet with the toner image fixed thereon is ejected to the ejection tray section 38 by the ejection roller 36 and is stacked on the ejection tray section 38. Therefore, the sheets in the sheet supply cassette 20 are sequentially ejected to the ejection tray section 38 through the path shaped like a letter C.

For example, four toner bottles 40 are provided on an opposite end side of the image formation apparatus main unit 12 (on the right end side in the figure). The toner bottles 40 store yellow, magenta, cyan, and black toners for supplying the toners to the image formation sections 16 via a toner supply path (not shown).

The intermediate transfer belt 14 is supported on plural transport rolls 42 and the belt face where the image formation sections 16 are provided is inclined relative to the horizontal direction. One of the transport rolls 42 forms a backup roller of the second transfer roller 32. An intermediate belt cleaning device 44 is placed in the proximity of the upper end of the intermediate transfer belt 14 and another one of the transport rolls 42 forms a backup roller of the intermediate belt cleaning device 44. Further, a tension roller 46 is placed in the upper part of the intermediate transfer belt 14 for giving an adequate tension to the intermediate transfer belt 14.

Each of the image formation sections 16 is made up of an image formation unit 48 provided on one face of the intermediate transfer belt 14 and a first transfer roller 50 provided on the back of the intermediate transfer belt 14. The image formation unit 48 is provided detachably for the image formation apparatus main unit 12 and can be drawn out in the front direction in the figure after it is once moved downward.

A controller 52 is disposed in the image formation apparatus main unit 12 for controlling the components of the image formation apparatus main unit 12.

Figure 2:
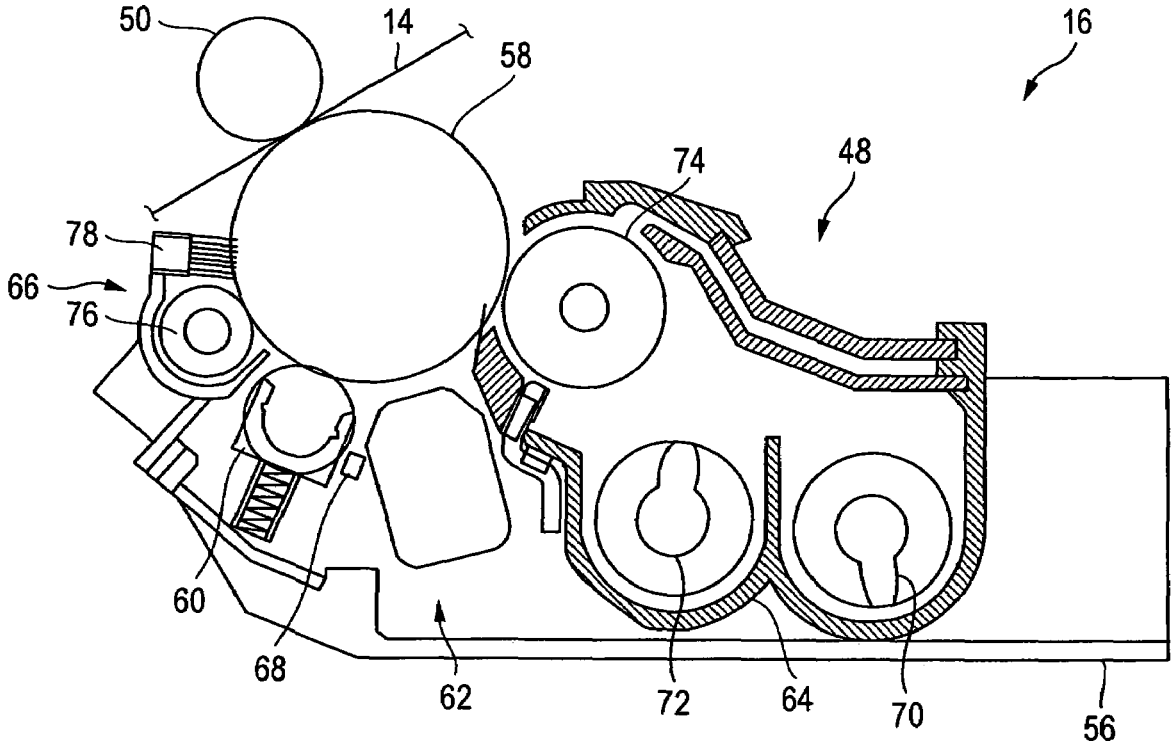
FIG. 2 is a longitudinal sectional view to show an image formation section according to an exemplary embodiment of the invention.

FIG. 2 shows the details of one of the image formation section 16. The image formation unit 48 has an image formation unit main body 56 and includes a photoconductor 58 opposed to the intermediate transfer belt 14, a charging device 60 implemented as a roller, for example, for charging the photoconductor 58, an exposure device 62 implemented as a light emitting diode (LED), for example, for applying light onto the photoconductor 58 and forming a latent image, a developing device 64 for developing the latent image formed on the photoconductor 58 by the exposure device 62 with toner, and a cleaner 66 for cleaning remaining toner on the photoconductor 58 after transfer, the components being housed in the image formation unit main body 56.

The developing device 64 uses a developer containing toner and carriers in a two-component system, for example, and has two augers 70 and 72 placed in parallel in a horizontal direction, for example, and a developing roller 74 placed in a slanting direction above the ejection auger 72 for agitating the developer and supplying the developer to the developing roller 74. On the developing roller 74, a magnetic brush of carriers is formed for transporting toner deposited on the carriers and the latent image on the photoconductor 58 is developed with the toner.

The cleaner 66 has a cleaning roller 76 and a cleaning brush 78. The cleaning roller 76 is provided so as to come in contract with the photoconductor 58 and to be able to rotate, and the cleaning brush 78 is placed upstream in the rotation direction of the photoconductor 58 from the cleaning roller 76 so as to come in contact with the photoconductor 58. The cleaning brush 78 attracts the remaining toner deposited on the surface of the photoconductor 58 onto the cleaning brush 78 or scrapes the remaining toner downstream in the rotation direction of the cleaning brush 78 for removing the remaining toner. The cleaning roller 76 attracts the toner not removed by the cleaning brush 78 and remaining on the surface of the photoconductor 58 for removing the remaining toner from the photoconductor 58.

The image formation unit main body 56 is provided with an environmental sensor 68 as an environment detector for detecting the surrounding environment of the photoconductor 58. The environmental sensor 68 is connected to the controller 52 (shown in FIG. 1) and detects the temperature and the humidity in the surroundings of the photoconductor 58 and outputs the detection result to the controller 52.

In the described configuration, the intermediate transfer belt 14 and the photoconductor 58 rotate in opposite directions in synchronization with each other, the charging device 60 charges the surface of the photoconductor 58, and the exposure device 62 forms a latent image. The latent image formed on the photoconductor 58 by the exposure device 62 is developed by the developing device 64. The toner image developed by the developing device 64 is transferred to the intermediate transfer belt 14 by the first transfer roller 50. The color toner images formed by the image formation sections 16 are superposed on each other with a move of the intermediate transfer belt 14.

On the other hand, the sheets stacked in the sheet supply cassette 20 of the sheet supply unit 18 are delivered one at a time to the sheet transportation path 28 by the pickup roller 22, the feed roller 24, the retard roller 26, etc. The sheet delivered to the sheet transportation path 28 abuts the registration roller 30, is temporarily stopped, and is sent to the second transfer roller 32 at a proper timing. The toner image on the intermediate transfer belt 14 is transferred to the sheet by the second transfer roller 32. The sheet to which the toner image is transferred is further sent to the fixing device 34, and the toner image is fixed onto the sheet by heat and pressure. The sheet where the toner image is fixed by the fixing device 34 is ejected to the ejection tray section 38 by the ejection roller 36.

Next, the photoconductor 58 and the charging device 60 will be discussed in detail.

Figure 3:
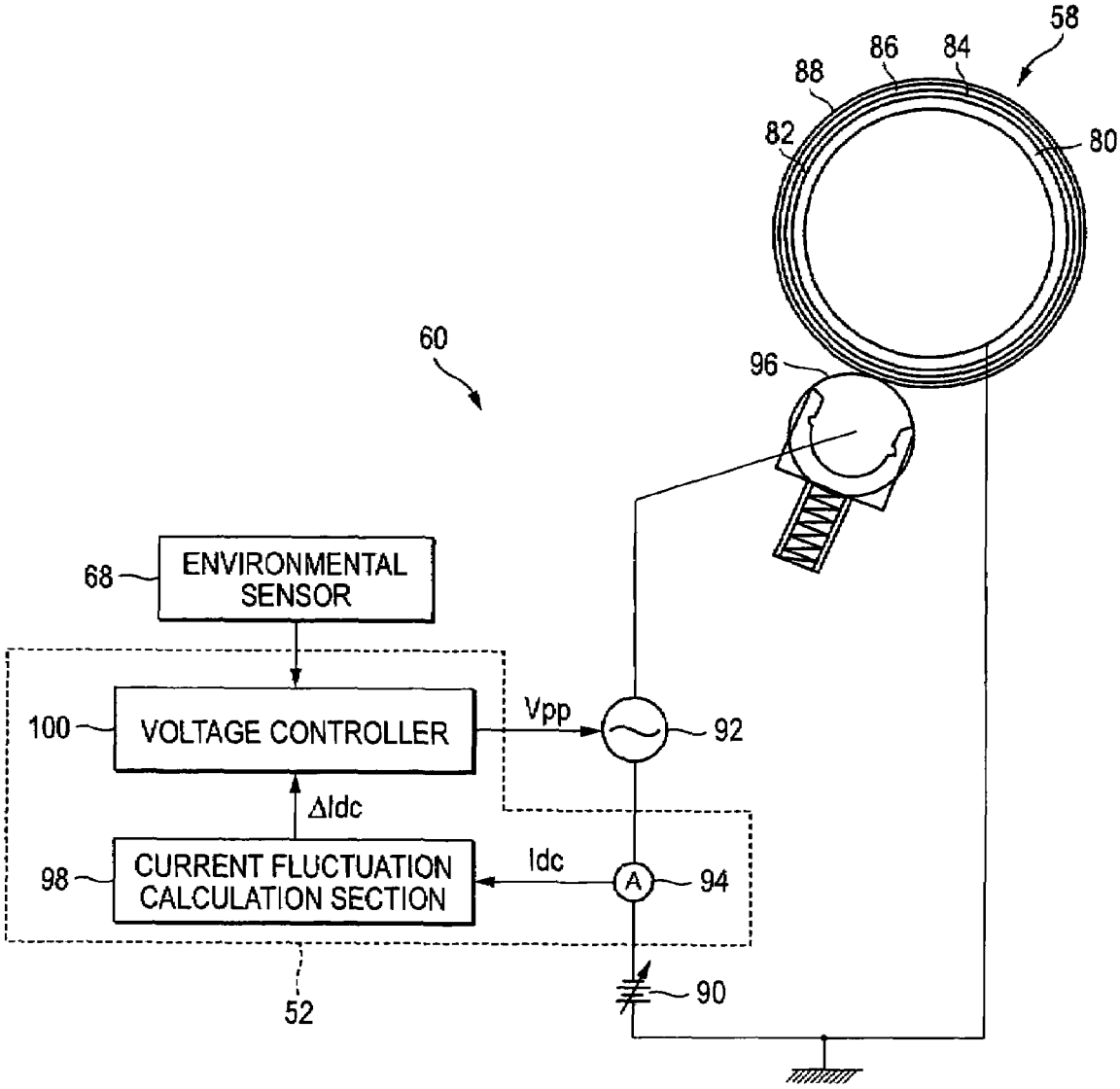
FIG. 3 is a schematic drawing to show the configurations of a photoconductor and a charging device according to an exemplary embodiment of the invention.

FIG. 3 is a drawing to schematically show the configurations of the photoconductor 58 and the charging device 60.

The photoconductor 58 is of layered type and has four layers stacked on a drum substrate 80 made of aluminum, for example. An intermediate layer 82 is stacked on the drum substrate 80 and is used for various functions including electric conduction. A charge generation layer 84 is stacked as a thin layer having a film thickness of 1 μm or less, for example, on the intermediate layer 82 and is a layer with a charge generation material dispersed in a resin binder, for example, in a state of pigment fine particles. A charge transport layer 86 is stacked on the charge generation layer 84 as a film thickness of 15 to 25 μm, for example, and is a layer with a charge transport material dispersed and dissolved in a resin binder. To use a high-hardness material as the surface layer of the photoconductor 58, an image defect like a white spot may be caused to occur due to a charging failure and therefore the charge generation layer 84 may have a film thickness of 25 μm or less.

A surface protective layer (surface layer) 88 is stacked on the charge transport layer 86 as a film thickness of 3 to 5 μm, for example, uses a material having high hardness, such as an a-SiN:H film, an a-C:H film not containing Si, or an a-C:H:F film, and has abrasive resistance with the abrasion amount for 1000 revolutions (1K cycle) being 20 nm or less. If a high-hardness material is thus used for the surface protective layer 88, abrasion of the surface layer of the photoconductor 58 is suppressed and a corona product may be deposited on the surface of the photoconductor 58. A method of suppressing the corona product is described later.

The charging device 60 has a DC power supply 90, an AC power supply 92, and a charging roller 96. The DC power supply 90 generates a DC voltage as a DC component of a charge bias power supply. The AC power supply 92 generates an AC component voltage (AC voltage (Vpp: Peak to peak voltage)) under the control of the controller 52 and superposes the generated AC voltage (Vpp) on the DC component voltage (DC voltage) generated by the DC power supply 90 to form a charge bias voltage. The charging roller 96 is in contact with the photoconductor 58 for charging the surface of the photoconductor 58 using the charge bias voltage generated by the DC power supply 90 and the AC power supply 92.

The controller 52 has an ammeter 94, a current fluctuation calculation section 98, and a voltage controller 100. The ammeter 94 detects the current value of a DC component (DC current (Idc)) flowing between the photoconductor 58 and the charging device 60 and outputs the current value to the current fluctuation calculation section 98. The ammeter 94 may detect the AC current (Iac) flowing between the photoconductor 58 and the charging device 60. The current fluctuation calculation section 98 calculates a DC current fluctuation amount (ΔIdc) based on the DC current (Idc) and outputs the calculation result to the voltage controller 100. The voltage controller 100 controls the AC voltage (Vpp) based on the DC current fluctuation amount (ΔIdc) output from the current fluctuation calculation section 98 and the temperature value and the humidity value output from the environmental sensor 68.

Figure 4A:
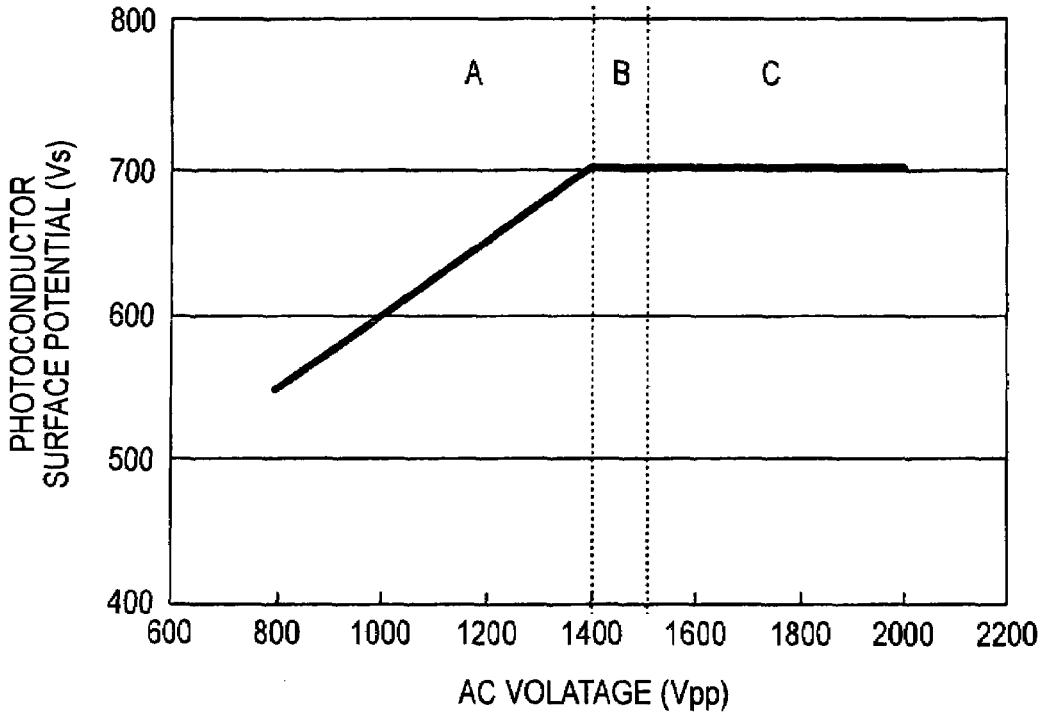
FIG. 4A is a graph to show the relationship between AC voltage (Vpp) and photoconductor surface potential (Vs) and FIG. 4B is a graph to show the relationship between AC voltage (Vpp) and DC current fluctuation amount (ΔIdc) as for charging of the photoconductor according to an exemplary embodiment of the invention.

FIG. 4A shows the relationship between the AC voltage (Vpp) and a surface potential (Vs) of the photoconductor 58.

As shown in FIG. 4A, if the AC voltage (Vpp) is increased, the surface potential (Vs) of the photoconductor 58 increases linearly and then is saturated. If the AC voltage (Vpp) is equal to or less than the saturation point of the surface potential (Vs) of the photoconductor 58 (area represented by "B" in FIG. 4A), uneven charging easily occurs on the surface of the photoconductor 58. Even if the AC voltage (Vpp) is equal to or greater than the saturation point of the surface potential (Vs) of the photoconductor 58, when it exceeds a value (area represented by "C" in FIG. 4A), a corona product occurs and is deposited on the surface of the photoconductor 58. Therefore, the AC voltage (Vpp) needs to be controlled within the range of the lower limit where uneven charging does not substantially occur to the upper limit where a corona product does not substantially occur, namely, within a range equal to or greater than the saturation point of the surface potential (Vs) of the photoconductor 58 (area represented by "B" in FIG. 4A).

The saturation point of the surface potential (Vs) of the photoconductor 58 also has a characteristic of changing with the temperature and the humidity in the image formation apparatus main unit 12. That is, the saturation point moves to lower AC voltage (Vpp) (in the left direction in FIG. 4A) when the temperature and the humidity are high, and the saturation point moves to higher AC voltage (Vpp) (in the right direction in FIG. 4A) when the temperature and the humidity are low.

Figure 4B:
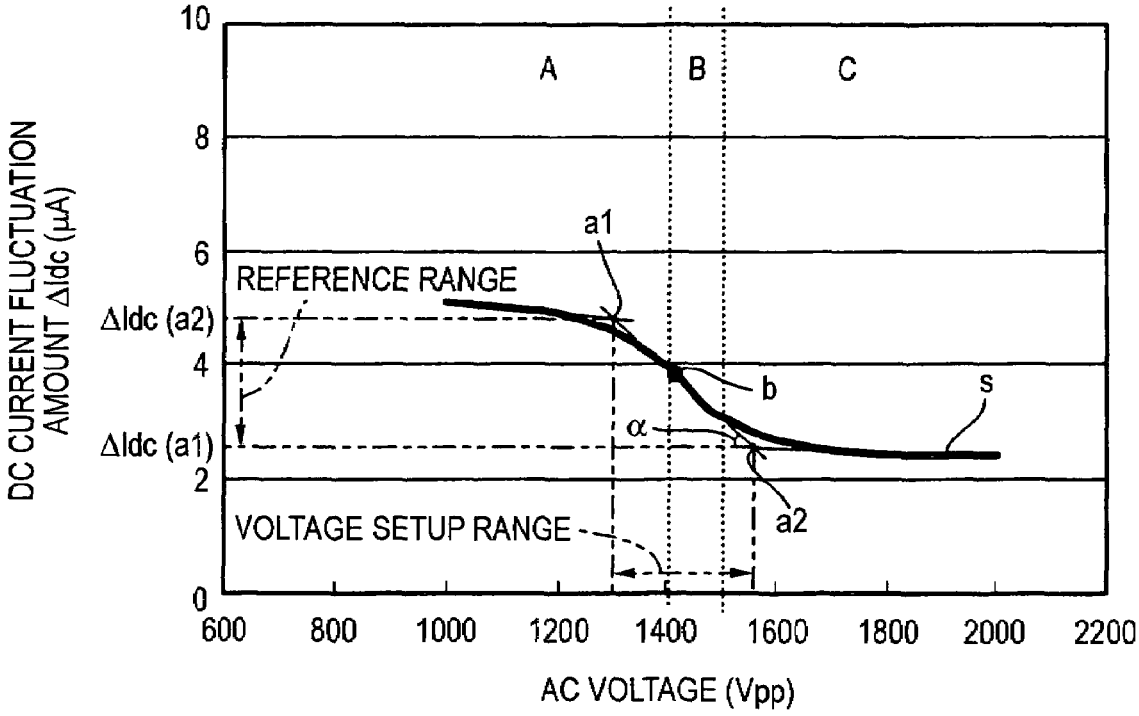

FIG. 4B shows the relationship between the AC voltage (Vpp) and the DC current fluctuation amount (ΔIdc). As compared with FIG. 4A, when the surface potential (Vs) of the photoconductor 58 is equal to or less than the saturation point (for example, the area represented by "A" in FIG. 4B), the DC current fluctuation amount (ΔIdc) is large because uneven charging easily occurs. If the AC voltage (Vpp) is increased, the DC current fluctuation amount (ΔIdc) gradually lowers in the vicinity of the saturation point of the surface potential (Vs) of the photoconductor 58 (area represented by "B" in FIG. 4B) and if the AC voltage (Vpp) is further increased, the DC current fluctuation amount (ΔIdc) maintains a small value (area represented by "C" in FIG. 4B). Using this characteristic in the change of the DC current fluctuation amount (ΔIdc) relative to the AC voltage (Vpp), the AC voltage (Vpp) is controlled in the range of the lower limit where uneven charging does not substantially occur to the upper limit where a corona product does not substantially occur. Specifically, the AC voltage (Vpp) is controlled so that the DC current fluctuation amount (ΔIdc) is in a reference range (for example, ΔIac (a1) to ΔIac (a2)) in FIG. 4B.

The reference range in the DC current fluctuation amount (ΔIdc) can be determined as follows: For example, change (curve S in FIG. 4B) of the DC current fluctuation amount (ΔIdc) relative to change of the AC voltage (Vpp) is divided into three areas (for example, a portion in which the change of the DC current fluctuation amount (ΔIdc) is large and other portions), linear approximation is executed in each area, and the range between the fluctuation amounts of the DC currents (for example, ΔIdc (a1) and ΔIdc (a2) in FIG. 4B) at two intersection points on the lines (for example, a1 and 2 in FIG. 4B) is adopted as the reference range.

Alternatively, the range having the ratio of change of the DC current fluctuation amount (ΔIdc) to change of the AC voltage (Vpp), namely, a gradient (gradient α in FIG. 4B) may be adopted as the reference range. A given area based on the inflection point (inflection point b in FIG. 4B) of the change (curve S in FIG. 4B) of the DC current fluctuation amount (ΔIdc) relative to change of the AC voltage (Vpp) may be adopted as the reference range.

Next, a setting method of the AC voltage (Vpp) in the controller 52 will be discussed.

Figure 5:
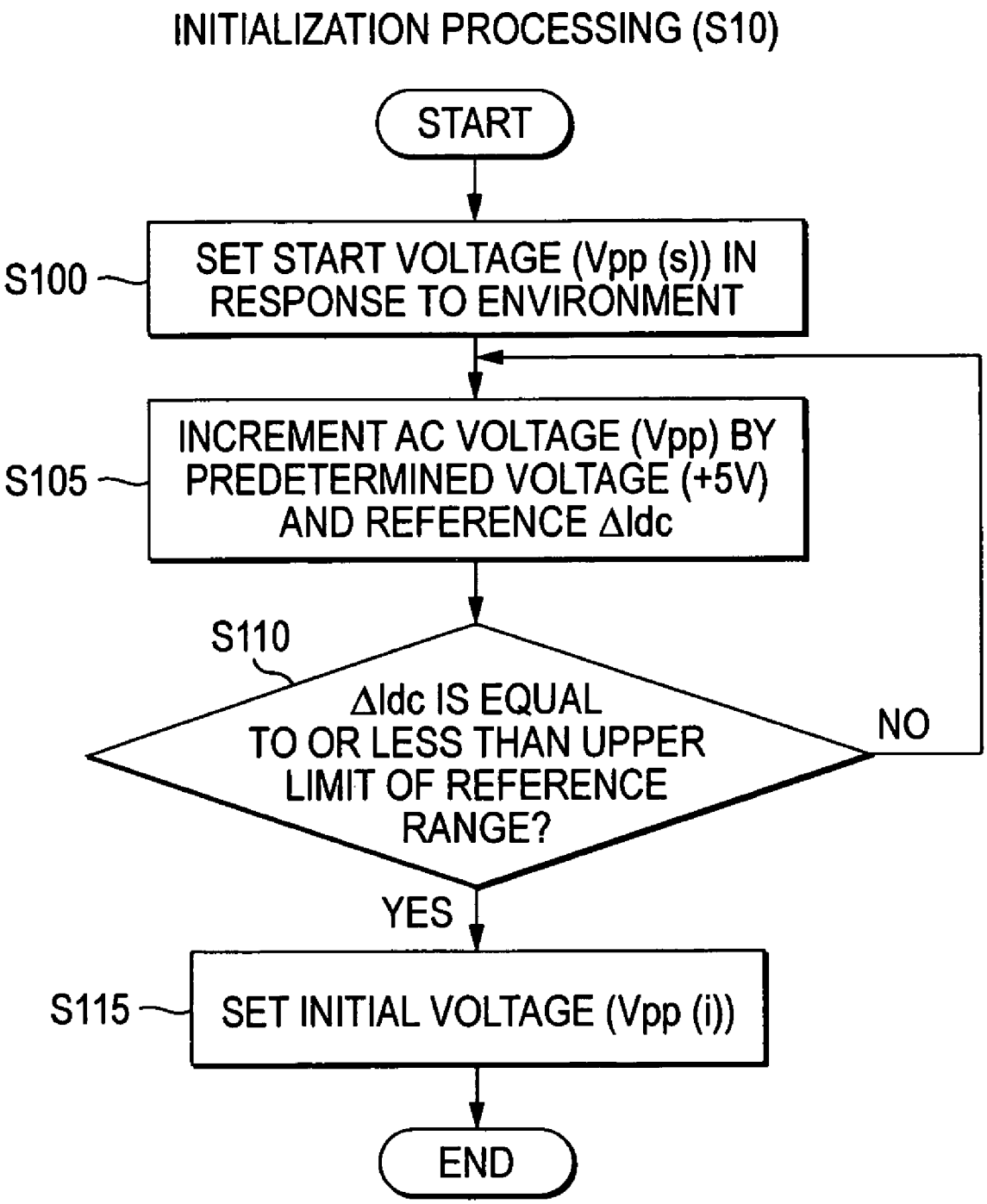
FIG. 5 is a flowchart to describe initialization processing of AC voltage (Vpp) in the charging device according to an exemplary embodiment of the invention.

FIG. 5 is a flowchart to describe initialization processing (S10). The initialization processing (S10) is performed before usual print processing.

As shown in FIG. 5, at step S100, the controller 52 sets start voltage (Vpp(s)) based on the temperature value and the humidity value output from the environmental sensor 68 (for example, the start voltage (Vpp(s)) under the conditions of temperature 30° C. and humidity 80% is 1,200 V).

The start voltage (Vpp(s)) is thus set according to the output values of the environmental sensor 68, whereby the time to setting of initial voltage (Vpp(i)) described later (standby time) is shortened and if the saturation point of the surface potential (Vs) of the photoconductor 58 changes due to the temperature and the humidity in the image formation apparatus main unit 12, the optimum start voltage (V pp(s)) can be set.

At step S105, the controller 52 increments the initial voltage (Vpp(i)) by a voltage (for example, 5 V) and references the DC current fluctuation amount (ΔIdc) output by the ammeter 94 at this time.

At step S110, the controller 52 determines whether or not the DC current fluctuation amount (ΔIdc) referenced at step S105 is equal to or less than the upper limit value of the reference range (for example, shown in FIG. 4B). If the DC current fluctuation amount (ΔIdc) is equal to or less than the upper limit value, the controller 52 goes to step S115; otherwise, the controller 52 returns to step S105.

At step S115, the controller 52 sets the AC voltage (Vpp) corresponding to the DC current fluctuation amount (ΔIdc) referenced at step S105 to the initial voltage (Vpp(i)).

Thus, the controller 52 repeats the processing at steps S105 and S110 a number of times, thereby incrementing the AC voltage (Vpp) by a voltage (for example, 5 V) from the start voltage (Vpp(s)) and setting the initial voltage (Vpp(i)) used in charging control processing (S20) described later.

Figure 6:
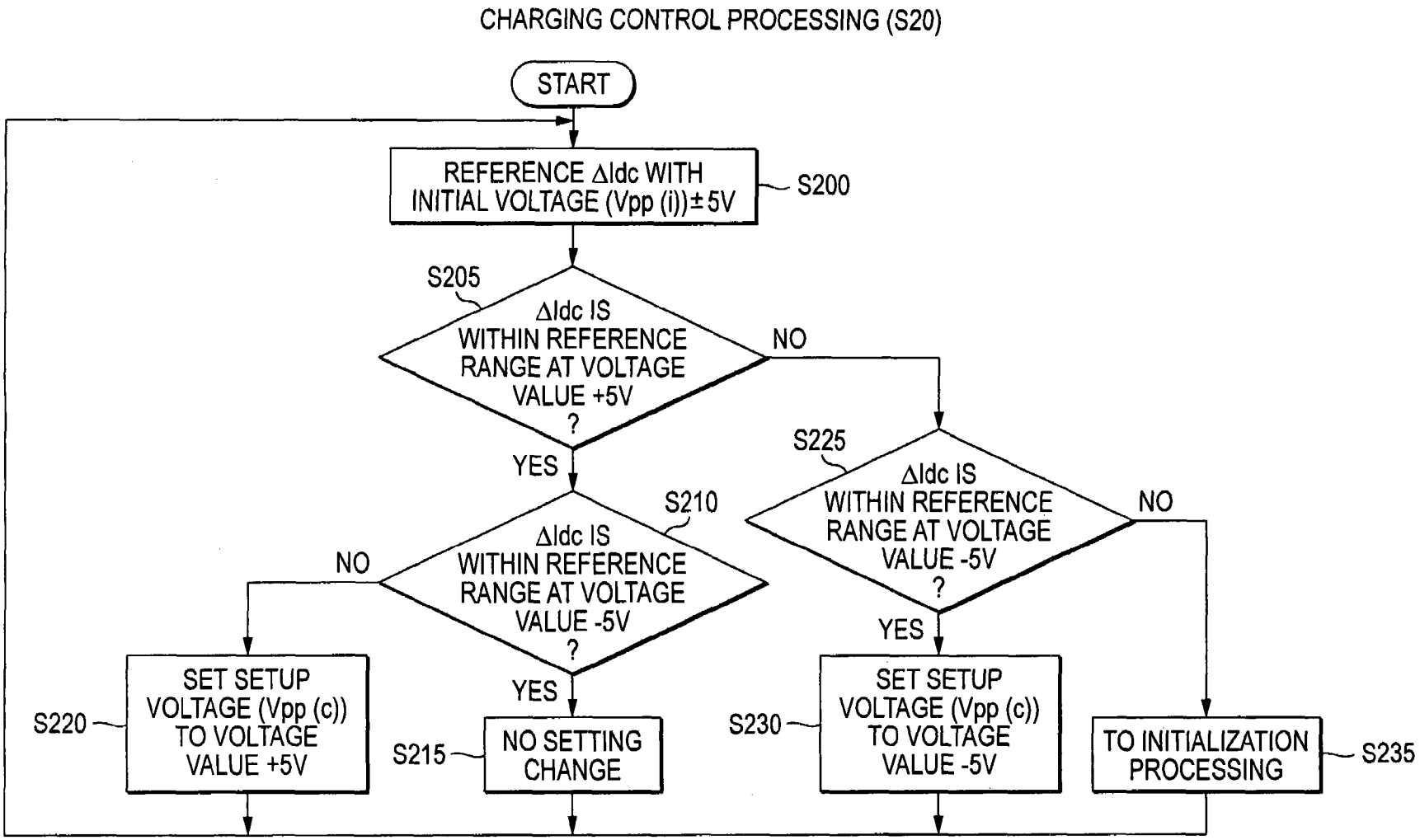
FIG. 6 is a flowchart to describe charging control processing of the charging device according to an exemplary embodiment of the invention.

FIG. 6 is a flowchart to describe the charging control processing (S20). The charging control processing (S20) is performed at usual print processing time.

As shown in FIG. 6, at step S200, the controller 52 changes the AC voltage (Vpp) by voltages (for example, 5 V to the plus side and 5 V to the minus side) with the initial voltage (Vpp(i)) set according to the initialization processing (S10) described above as the center, and references the DC current fluctuation amount (ΔIdc) output by the ammeter 94 at the time.

At step S205, the controller 52 determines whether or not the DC current fluctuation amount (ΔIdc) when the AC voltage (Vpp) is changed to the plus side (for example, +5 V) at step S200 is within the reference range (for example, shown in FIG. 4 (*b*)). If the DC current fluctuation amount (ΔIdc) is within the reference range, the controller 52 goes to step S210; if the DC current fluctuation amount (ΔIdc) is outside the reference range, the controller 52 goes to step S225.

At step S210, the controller 52 determines whether or not the DC current fluctuation amount (ΔIdc) when the AC voltage (Vpp) is changed to the minus side (for example, −5 V) at step S200 is within the reference range (for example, shown in FIG. 4(*b*)). If the DC current fluctuation amount (ΔIdc) is within the reference range, the controller 52 goes to step S215; if the DC current fluctuation amount (ΔIdc) is outside the reference range, the controller 52 goes to step S220.

At step S215, the controller 52 adopts the initial voltage (Vpp(i)) described above as a setup voltage (Vpp(c)). That is, if the DC current fluctuation amount (ΔIdc) is within the reference range although the AC voltage (Vpp) is changed by voltages (for example, 5 V to the plus side and 5 V to the minus side) with the initial voltage (Vpp(i)) as the center, the controller 52 determines that the initial voltage (Vpp(i)) is in the proximity of the center value within the voltage setup range (shown in FIG. 4B), and does not change the setting of the AC voltage ( Vpp).

At step S220, the controller 52 adopts the voltage value resulting from adding a voltage (for example, 5 V) to the initial voltage (Vpp(i)) described above as the setup voltage (Vpp(c)). That is, since the DC current fluctuation amount (ΔIdc) when the AC voltage (Vpp) is changed to the plus side (for example, +5 V) is within the reference range and the DC current fluctuation amount (ΔIdc) when the AC voltage (Vpp) is changed to the minus side (for example, −5 V) is outside the reference range, the controller 52 determines that the initial voltage (Vpp(i)) is in the proximity of the lower limit value of the voltage setup range (shown in FIG. 4B), and increments the setup value of the AC voltage (Vpp).

At step S225, the controller 52 determines whether or not the DC current fluctuation amount (ΔIdc) when the AC voltage (Vpp) is changed to the minus side (for example, −5 V) at step S200 is within the reference range (for example, shown in FIG. 4B). If the DC current fluctuation amount (ΔIdc) is within the reference range, the controller 52 goes to step S230; if the DC current fluctuation amount (ΔIdc) is outside the reference range, the controller 52 goes to step S235.

At step S230, the controller 52 adopts the voltage value resulting from subtracting a voltage (for example, 10 V) from the initial voltage (Vpp(i)) described above as the setup voltage (Vpp(c)). That is, since the DC current fluctuation amount (ΔIdc) when the AC voltage (Vpp) is changed to the minus side (for example, −5 V) is within the reference range and the DC current fluctuation amount (ΔIdc) when the AC voltage (Vpp) is changed to the plus side (for example, +5 V) is outside the reference range, the controller 52 determines that the initial voltage (Vpp(i)) is in the proximity of the upper limit value of the voltage setup range (shown in FIG. 4B), and decrements the setup value of the AC voltage (Vpp).

At step S235, the controller 52 goes to step S100 of the initialization processing (S10) described above and again sets the initial voltage (Vpp(i)). That is, since the DC current fluctuation amount (ΔIdc) when the AC voltage (Vpp) is changed to the plus side (for example, +5 V) is outside the reference range and the DC current fluctuation amount (ΔIdc) when the AC voltage (Vpp) is changed to the minus side (for example, −5 V) is also outside the reference range, the controller 52 determines that the initial voltage (Vpp(i)) is outside the voltage setup range (shown in FIG. 4B), and again sets the initial voltage (Vpp(i)).

At S200, the AC voltage (Vpp) is changed by voltages with the initial voltage (Vpp(i)) set according to the initialization processing (S10) as the center. After the setup voltage (Vpp (c)) is set at step 220, step S215, or step S230, the voltage is changed by voltages with the setup voltage (Vpp(c)) as the center and further at step S205, step S210, and step S225, the controller 52 determines whether or not the DC current fluctuation amount (ΔIdc) corresponding to change of the setup voltage (Vpp(c)) is within the reference range.

Thus, the controller 52 repeats the processing at steps S200 to S220, step S215, and step S230 for controlling so that the setup voltage (Vpp(c)) is almost in the center of the voltage setup range. Therefore, the AC voltage (Vpp) can be controlled so as to become in the range equal to or greater than the saturation point of the surface potential (Vs) of the photoconductor 58, namely, in the range of the lower limit where uneven charging does not substantially occur to the upper limit where a corona product does not substantially occur. Further, if the saturation point of the surface potential (Vs) of the photoconductor 58 changes due to the temperature and the humidity in the image formation apparatus main unit 12, the optimum setup voltage (Vpp(c)) can be determined.

In the invention, the AC voltage (Vpp) is used for the charging control of the controller 52, but the invention is not limited to the mode and the AC current (Iac) may be controlled.

As described above, the invention can be used for an image formation apparatus provided with a photoconductor and a charging device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image formation apparatus comprising:

a photoconductor;

a charging section that applies a bias voltage having an AC voltage superposed on a DC voltage to the photoconductor so as to charge the photoconductor;

a controller that controls at least one of the AC voltage and an AC current in response to a fluctuation amount of a DC current-flowing between the photoconductor and the charging section when an AC voltage is applied; and a detector that detects the DC current.

2. The image formation apparatus according to claim 1, wherein the controller controls the at least one of the AC voltage and the AC current so that the fluctuation amount of the DC current is within a range containing an inflection point when the fluctuation amount of the DC current changes in response to change of the at least one of the AC voltage and the AC current.

3. The image formation apparatus according to claim 1, further comprising an environment detector that detects an environment, wherein the controller changes an initial value of control in response to a detection result of the environment detector.

4. The image formation apparatus according to claim 1, wherein the photoconductor has an abrasion amount of 20 nm or less for 1,000 revolutions thereof.

5. The image formation apparatus according to claim 1, wherein the photoconductor comprises a charge transport layer having a thickness of 25 μm or less.

6. The image formation apparatus according to claim 3, wherein the environment detector detects at least one of a temperature value and a humidity value as the environment.

* * * * *